US009254399B2

(12) United States Patent
Qiang et al.

(10) Patent No.: US 9,254,399 B2
(45) Date of Patent: Feb. 9, 2016

(54) PORTABLE FIRE EXTINGUISHING DEVICE

(75) Inventors: Jian Qiang, Xi'an (CN); Zhengjun Lei, Xi'an (CN)

(73) Assignee: XI'AN J&R FIRE FIGHTING EQUIPMENT CO., LTD. (CN)

( * ) Notice: Subject to any disclaimer, the term of this patent is extended or adjusted under 35 U.S.C. 154(b) by 0 days.

(21) Appl. No.: 14/347,967

(22) PCT Filed: Aug. 16, 2012

(86) PCT No.: PCT/CN2012/080226
§ 371 (c)(1),
(2), (4) Date: Mar. 27, 2014

(87) PCT Pub. No.: WO2013/044700
PCT Pub. Date: Apr. 4, 2013

(65) Prior Publication Data

US 2014/0216767 A1 Aug. 7, 2014

(30) Foreign Application Priority Data

Sep. 28, 2011 (CN) ..... 2011 2 0377486 U

(51) Int. Cl.
*A62C 13/00* (2006.01)
*A62C 19/00* (2006.01)
*A62C 13/76* (2006.01)

(52) U.S. Cl.
CPC ..... *A62C 19/00* (2013.01); *A62C 13/76* (2013.01)

(58) Field of Classification Search
CPC ..... A62C 13/76; A62C 19/00; A62C 13/22
USPC ..... 169/26, 28, 30, 84; 220/4.01, 4.21, 220/4.24, 23.89
See application file for complete search history.

(56) References Cited

U.S. PATENT DOCUMENTS 1,588,234 A * 6/1926 Kauch et al. ..... 169/28
2,057,840 A * 10/1936 Neumann ..... 169/28
(Continued)

FOREIGN PATENT DOCUMENTS

CA 2758603 A1 8/2011
CN 2395749 Y 9/2000
(Continued)

OTHER PUBLICATIONS

International Search Report for corresponding application PCT/CN2012/080226 filed Aug. 16, 2012; Mail date Nov. 15, 2012.
(Continued)

*Primary Examiner* — Jason Boeckmann
(74) *Attorney, Agent, or Firm* — Cantor Colburn LLP

(57) ABSTRACT

Disclosed is a portable fire extinguishing device, which comprises a casing (1) and a cartridge (2) provided inside the casing (1). The device is characterized in that: the casing (1) comprises a first half casing (4), a second half casing (5) fitted to the first half casing (4), a fastening ring (6) and a bottom cover (7); the first half casing (4) and the second half casing (5) are butted; the fastening ring (6) is provided on the top ends of the first half casing (4) and the second half casing (5) so as to fasten the both; and the bottom cover (7) is provided at the bottoms of the both. The first half casing, the second half casing, the fastening ring and the bottom cover are clamped and fixedly connected with each other to form a whole casing so that the whole wall thickness of the casing is uniform, thus improving injection moulding processes, reducing the difficulty in manufacturing a mould, saving plastic resources, and facilitating installation and disassembly.

8 Claims, 6 Drawing Sheets

(56) References Cited

U.S. PATENT DOCUMENTS

| | | | | |
|---|---|---|---|---|
| 2,502,923 | A * | 4/1950 | Burgoyne | 169/30 |
| 5,282,541 | A * | 2/1994 | Chen | 215/229 |
| 5,992,531 | A | 11/1999 | Mikulec | |
| 8,844,644 | B2 * | 9/2014 | Guo et al. | 169/84 |
| 2006/0175067 | A1 | 8/2006 | Cover | |
| 2011/0155398 | A1 | 6/2011 | Holland | |

FOREIGN PATENT DOCUMENTS

| | | | |
|---|---|---|---|
| CN | 1378867 | | 11/2002 |
| CN | 202236978 | U | 5/2012 |
| CN | 202236979 | U | 5/2012 |
| CN | 202236980 | U | 5/2012 |
| CN | 202236991 | U | 5/2012 |
| DE | 8900351 | U1 | 3/1989 |
| EP | 0693303 | A2 | 1/1996 |
| EP | 0750923 | | 1/1997 |
| EP | 0750923 | A2 | 1/1997 |
| FR | 2647354 | A1 * | 11/1990 |
| GB | 2190586 | | 11/1987 |
| JP | 8252338 | | 10/1996 |

OTHER PUBLICATIONS

International Search Report for corresponding application PCT/CN2012/080306 filed Aug. 17, 2012; Mail date Nov. 8, 2012.

International Search Report for corresponding application PCT/CN2012/080225 filed Aug. 16, 2012; Mail date Nov. 8, 2012.

European Search Report for corresponding application 12 83 5013.9; Dated May 15, 2015.

* cited by examiner

PORTABLE FIRE EXTINGUISHING DEVICE

TECHNICAL FIELD OF THE INVENTION

The invention belongs to the field of fire prevention technology, and particularly relating to a portable fire extinguishing device.

BACKGROUND OF THE INVENTION

At present, existing portable fire extinguishing devices are generally divided into pressure-storage dry powder fire extinguishing devices and handheld aerosol fire extinguishing devices, wherein a pressure-storage dry powder fire extinguishing device mainly has the following disadvantages: firstly, the pressure-storage dry powder fire extinguishing device causes serious pollution to the environment and serious damage to materials; secondly, the pressure-storage dry powder fire extinguishing device, which needs to store high pressure gas, is large in volume and heavy in weight; thirdly, the pressure-storage dry powder fire extinguishing device, which is a high pressure container, has potential safety hazards and is more dangerous in a high temperature environment of a fire; fourthly, the pressure-storage dry powder fire extinguishing device, which needs to go through regular surveillance tests and inspections, is high in routine maintenance costs etc.

By contrast, a handheld aerosol fire extinguishing device has obvious advantages and overcomes the disadvantages existing in the pressure-storage dry powder fire extinguishing device. The handheld aerosol fire extinguishing device mainly comprises: a cartridge, a cartridge cover arranged on the cartridge, and a pyrotechnic composition, an ignition head, a coolant and a ceramic chip etc. arranged in the cartridge in turn and coated by a heat insulation material. Normally, after a pyrotechnic column is ignited by the ignition head, a great deal of aerosol smog will be generated by the cartridge through rapid stratified combustion, and after being cooled by a coolant layer, these high temperature aerosols will be ejected from the a spout of the cartridge cover of the cartridge to act on a fire source directly, thus extinguishing the fire.

However, the handheld aerosol fire extinguishing device also has some disadvantages. A coating defect, a pyrotechnic composition crack or a serious blockage of a gas channel may lead to a sudden rise of the pressure in the cartridge to deflagrate the pyrotechnic column. As a result, a high pressure gas will thrust the cartridge cover forwards and will be vented rapidly to cast the cartridge cover and other substances in the cartridge forwards at an extremely high speed, thus causing a very large recoil force. The powerful recoil force drives the cartridge to move backwards rapidly, which is easy to cause an injury to an operator. At the same time, after explosion venting, the cartridge cover of the fire extinguishing device etc. will also break away from the cartridge rapidly and fly outwards for a relatively long distance, which may also cause other accidents. In addition, the fire extinguishing device has a cylindrical casing, and a mould thereof is difficult to manufacture. Moreover, in order to enhance the structural strength of the casing, the wall thickness of the casing is not uniform at the top and the bottom, thus injection moulding processes are complicated. Further, when assembled, the cartridge needs to extend from one end of the cylindrical casing into the bottom of the casing and is fixed subsequently, which leads to complicated assembly processes on one hand, and the fixing effect of the cartridge is difficult to control on the other hand.

SUMMARY OF THE INVENTION

To overcome disadvantages existing in a portable fire extinguishing device in the prior art, the invention provides a portable fire extinguishing device capable of effectively preventing explosion, releasing pressure, reducing a powerful recoil force generated by deflagration of a cartridge, improving injection moulding processes and reducing the difficulty in manufacturing a mould.

The technical solution applied by the invention to solve the technical problem is:

A portable fire extinguishing device, comprising a casing 1 and a cartridge 2 provided inside the casing 1, wherein the casing 1 comprises a first half casing 4, a second half casing 5 fitted to the first half casing 4, a fastening ring 6 and a bottom cover 7; the first half casing 4 and the second half casing 5 are butted; the fastening ring 6 is provided on the top ends of the first half casing 4 and the second half casing 5 so as to fasten the first half casing 4 and the second half casing 5; and the bottom cover 7 is provided at the bottoms of the first half casing 4 and the second half casing 5. In assembly, the cartridge 2 may be put into the first half casing 4 directly, and the second half casing 5 is locked subsequently to complete the assembly with a simple assembly process. In addition, the first half casing 4 and the second half casing 5 do not need to have non-uniform wall thicknesses, which improve injection mounding processes while reducing the difficulty in manufacturing a mould and saving plastic resources.

The first half casing 4 and the second half casing 5 are fixedly connected by means of clamping, riveting, or threaded connection; the first half casing 4 and the second half casing 5 form a cylinder, which facilitates assembly.

The first half casing 4 and the second half casing 5 may be locked through a clamping hook 8 provided at the edge of the first half casing 4 and a clamping hole 9 provided at the edge of the second half casing 5 and corresponding to the clamping hook 8, or may be switched to be locked through a clamping hook 8 provided at the edge of the second half casing 4 and a clamping hole 9 provided at the edge of the first half casing 4 and corresponding to the clamping hook 8, so that the first half casing 4 and the second half casing 5 are connected closely.

To realize reliable fixing and accurate locating of the fastening ring 6 and the bottom cover 7 with the first half casing 4 and the second half casing 5, annular bumps 10 are provided at the outer walls of two ends of the first half casing 4 and the second half casing 5 of the invention; the inner walls of the fastening ring 6 and the bottom cover 7 are provided with clamping points corresponding to the annular bumps 10.

A jet end of the cartridge 2 of the invention is further provided with an explosion venting device 3 so that a great deal of kinetic energy generated after deflagration of the fire extinguishing device may be dispersed or consumed effectively, thus reducing or even counteracting an acting force on the cartridge to avoid injuries caused by a recoil force and accidents caused after the cartridge cover flies outwards and greatly improve the safety performance of the fire extinguishing device.

The explosion venting device 3 comprises a frictional layer 14, a link 13, a link guiding unit 15 and a link limiting device 16; the link 13 is connected with a cartridge cover of the cartridge 2; the frictional layer 14 is provided between the link 13 and the outer wall of the cartridge 2; the frictional layer 14 provides a frictional resistance and a buffering force for the link 13 when the link is guided by the link guiding unit 15 to displace along a direction towards which a hot air stream of the cartridge 2 is ejected; the link guiding unit 15 is a device capable of providing a guiding function for the link 13 when the link is moving; the link limiting device 16 is a device capable of fixing the link 13 when an extremity of the link reaches an spout of the cartridge 2.

The guiding unit is a guiding ring fixedly connected with the link 13 or a guiding groove provided on the outer wall of the cartridge 2 and capable of enabling the link 13 to slide axially along the guiding groove; the link limiting device 16 comprises a flanging 17 fixedly connected with the jet end of the cartridge 2 and a clamping claw 19 for fixing the link 13; an elastic body 18 is provided between the flanging 17 and the link guiding unit 15 or is provided on a side face of the flanging 17.

The inner walls of the first half casing 4 and the second half casing 5 of the invention are respectively provided with annular ribs 11 and clamping ribs 12 corresponding with each other; in the meanwhile, the annular ribs 11 are fitted with the outer wall of the cartridge 2; this improves the structural strength of the casing 1 on one hand; in addition, accurate radial location of the cartridge 2 can be realized, and the degree of freedom of the cartridge in the radial direction thereof can be limited.

The bottom of the cartridge 2 of the invention is further provided with a locating lug boss fitted to the inner wall of the casing 1, thus the pyrotechnic column is located accurately in the axial direction after the casing 1 is folded to prevent the efficiency of the pyrotechnic column from being influenced by up-and-down oscillation thereof.

A portable fire extinguishing device of the invention mainly has the following advantages:

1. the invention applies a fastening ring and a bottom cover to clamp, fixedly connect and combine a clamped first half casing and second half casing to form a whole casing so that the whole wall thickness of the casing is uniform, thus improving injection moulding processes, reducing the difficulty in manufacturing a mould, saving plastic resources, and facilitating installation and disassembly;

2. a device having an explosion preventing and pressure releasing function is added to a cartridge of the invention to effectively disperse or consume a great deal of kinetic energy generated after deflagration of the fire extinguishing device through reasonably layout and connection of a link, a connection guiding unit, a link limiting device and a fictional layer, thus reducing or even counteracting an acting force acting on the cartridge, avoiding injuries caused by a recoil force and accidents caused after the cartridge cover flies outwards and greatly improving the safety performance of the fire extinguishing device;

3. fixing and accurate locating of the cartridge of the invention are realized in the axial direction, the radial direction and the bottom by clamping ribs, annular ribs and a locating lug boss so that the degree of freedom of the cartridge is completely limited to implement accurate locating and reliable fixing; in addition, the annular ribs improve the structural strength of a casing, and the clamping ribs are aligned to facilitate installation;

4. the annular ribs and clamping ribs are provided at the inner wall of the casing of the invention to fix the cartridge; a cavity is formed between the casing and the cartridge so that the fire extinguishing device has excellent heat insulation performance, thus avoiding the problem of a hot casing after ejection;

5. the first half casing and the second half casing of the invention are clamped through clamping hooks and clamping holes to implement close connection and accurate locating; in addition, the fastening ring and the bottom cover are clamped with the first half casing and the second half casing through annular bumps and clamping points, thus facilitating assembly and fixing; in addition, the fastening ring can be pushed outwards easily to absorb a part of explosion venting energy in the case of explosion venting of the cartridge.

Figure 1:
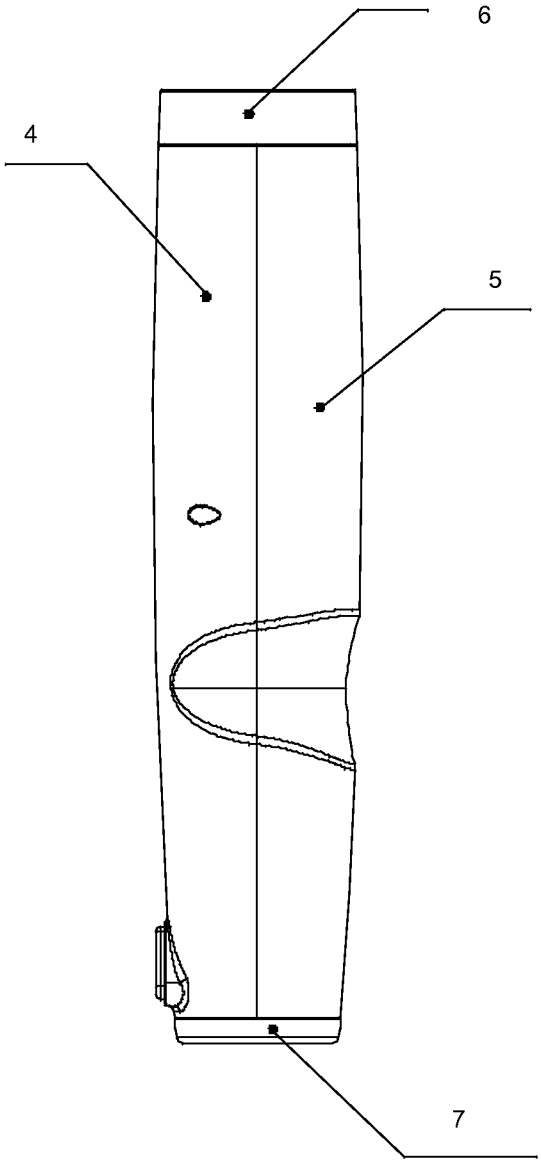
FIG. 1 is a structural diagram of the invention.

In the drawings: 1—casing, 2—cartridge, 3—explosion venting device, 4—first half casing, 5—second half casing, 6—fastening ring, 7—bottom cover, 8—clamping hook, 9—clamping hole, 10—annular bump, 11—annular rib, 12—clamping rib, 13—link, 14—frictional layer, 15—link guiding unit, 16—connectiong rod limiting device, 17—flanging, 18—elastic body, 19—clamping claw

DETAILED DESCRIPTION OF THE EMBODIMENTS

The invention relates to a portable fire extinguishing device, and preferred embodiments of the invention will be further described in combination with the drawings.

Figure 2:
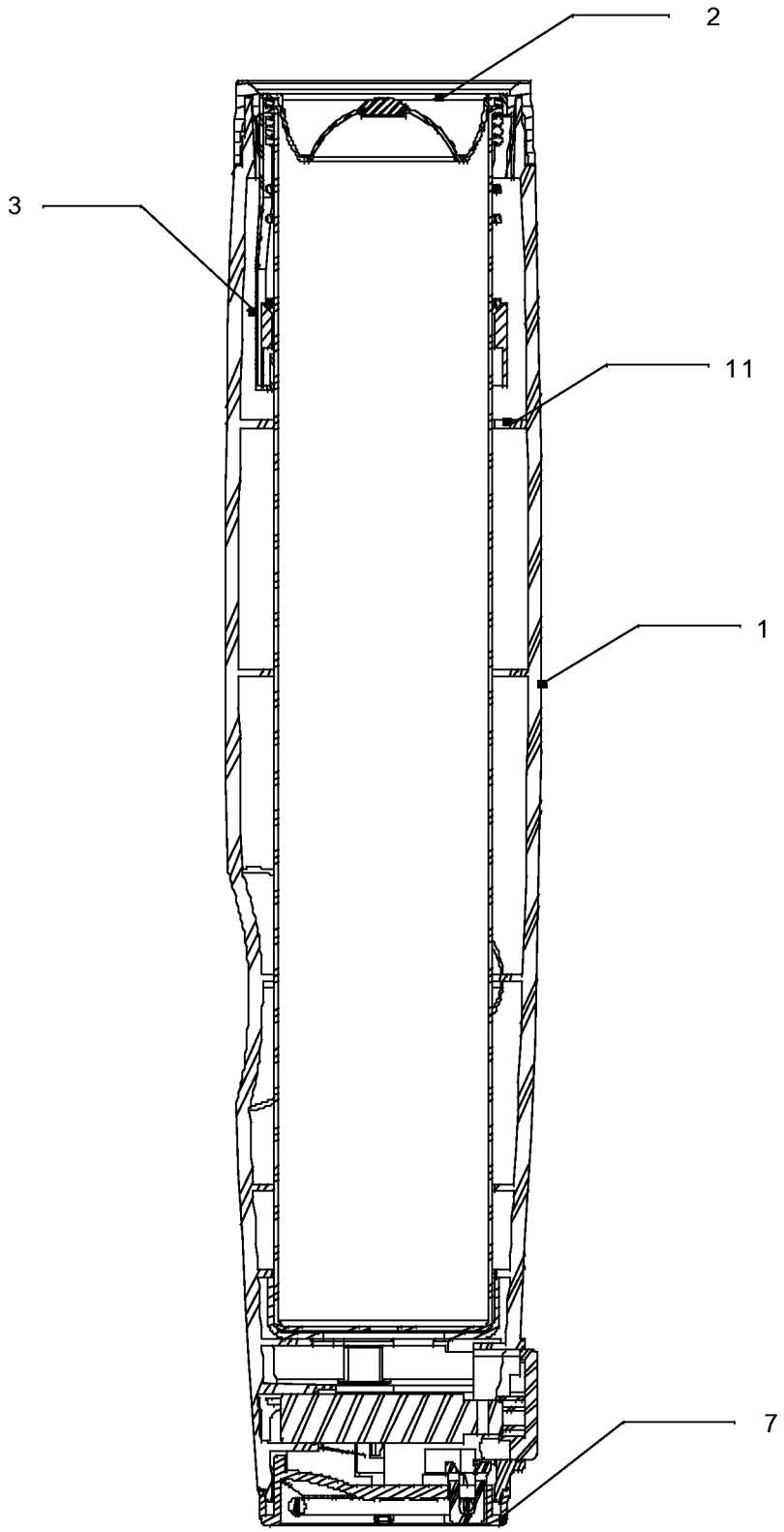
FIG. 2 is a sectional view of a fire extinguishing device of the invention.
Figure 3:
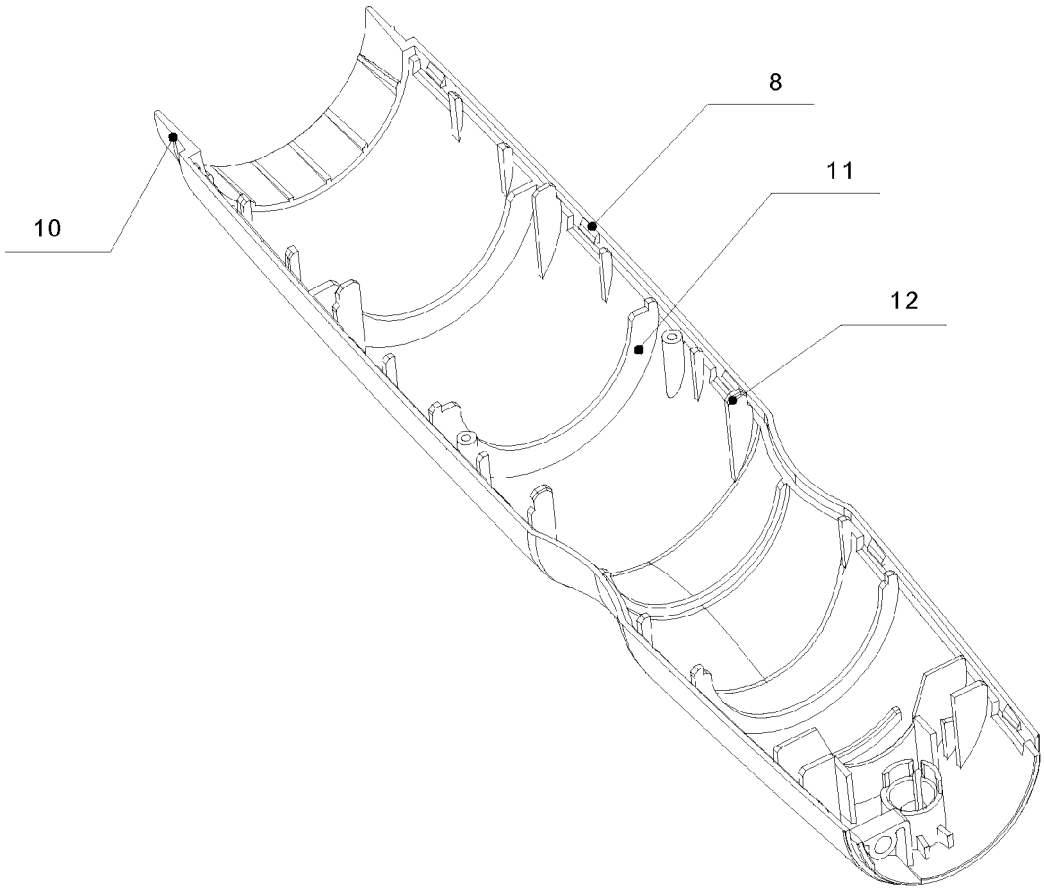
FIG. 3 is a structural diagram of a first half casing of the invention.
Figure 4:
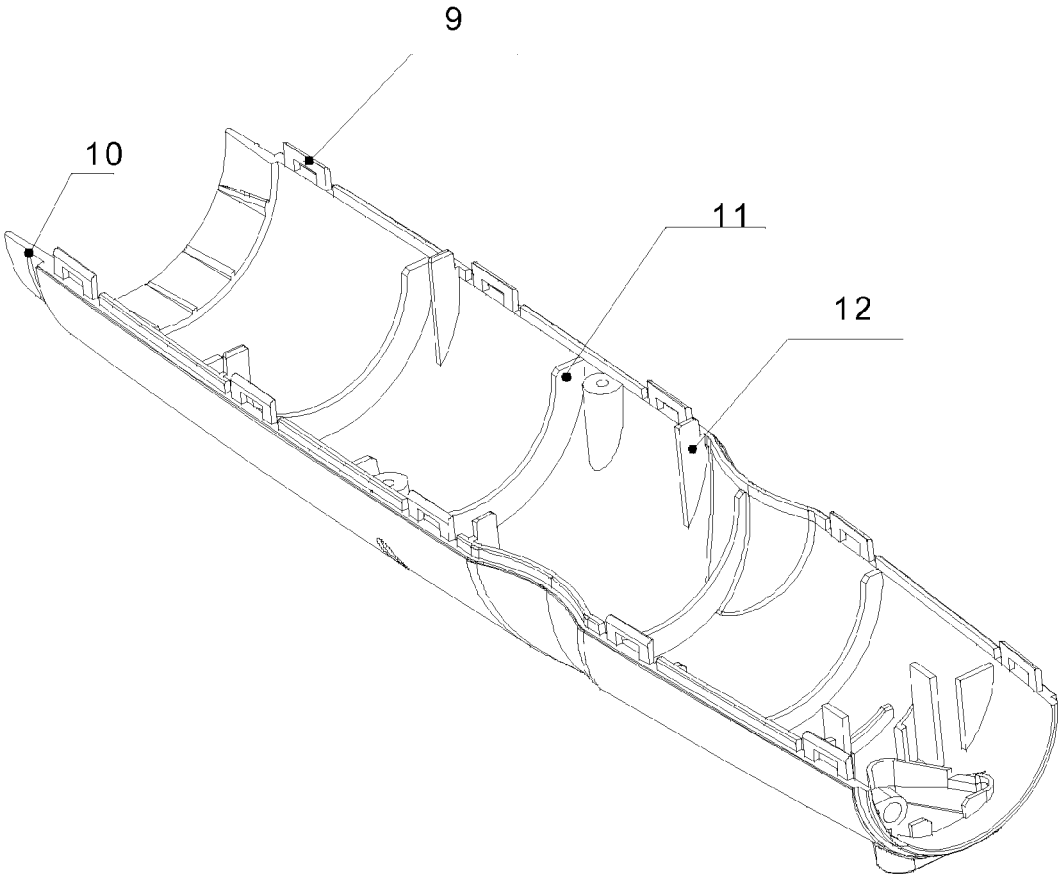
FIG. 4 is a structural diagram of a second half casing of the invention.

Referring to FIG. 1 and FIG. 2, the fire extinguishing device of the invention comprises a casing 1 and a cartridge 2 provided inside the casing 1; the casing 1 of the invention mainly comprises a first half casing 4, a second half casing 5, a fastening ring 6 and a bottom cover 7. The first half casing 4 and the second half casing 5 are structurally fitted and provided symmetrically to form a cylindrical structure, i.e. the section of the structure after the combination is circular, square, or in other closed shapes. The two sides of the first half casing 4 and the second half casing 5 are respectively provided with multiple clamping hooks 8 and clamping holes 9, and the first half casing 4 and the second half casing 5 are connected closely through locking of the clamping hooks 8 and the clamping holes 9, wherein the positions of the clamping hooks 8 and the clamping holes 9 on the first half casing 4 and the second half casing 5 may be switched, as long as the first half casing 4 and the second half casing 5 can be fixed through clamping and locking to form an integral body with a closed side face. The first half casing and the second half casing may be also fixed through other methods comprising threaded connection, riveting, or ultrasonic welding etc. Referring to FIG. 3 and FIG. 4, in order to implement accurate alignment and more reliable connection, the middle parts of the first half casing 4 and the second half casing 5 may be further locked through bolts. The inner walls of the first half casing 4 and the second half casing 5 are further provided with clamping ribs 11 capable of implementing axial locating and annular ribs 11 capable of implementing radial locating; the annular ribs 11 further need to fit the outer wall of the cartridge 2 simultaneously to tightly clamp the cartridge 2 and prevent the same from oscillating. The two ends of the first half casing 4 and the second half casing 5 of the invention can extend to the cartridge cover and the cartridge bottom of the cartridge 2 to fix the cartridge. To facilitate assembly and fixing of the cartridge 2, the two ends of the first half casing 4 and the second half casing 5 may be further provided with the fastening ring 6 and the bottom cover 7. To facilitate assembly and absorb a part of explosion venting energy during explosion venting, the inner walls of the fastening ring 6 and the bottom cover 7 are provided with multiple clamping points and at the same time, annular bumps 10 are provided on the corresponding outer walls of two ends of the first half casing 4 and the second half casing 5.

Figure 5:
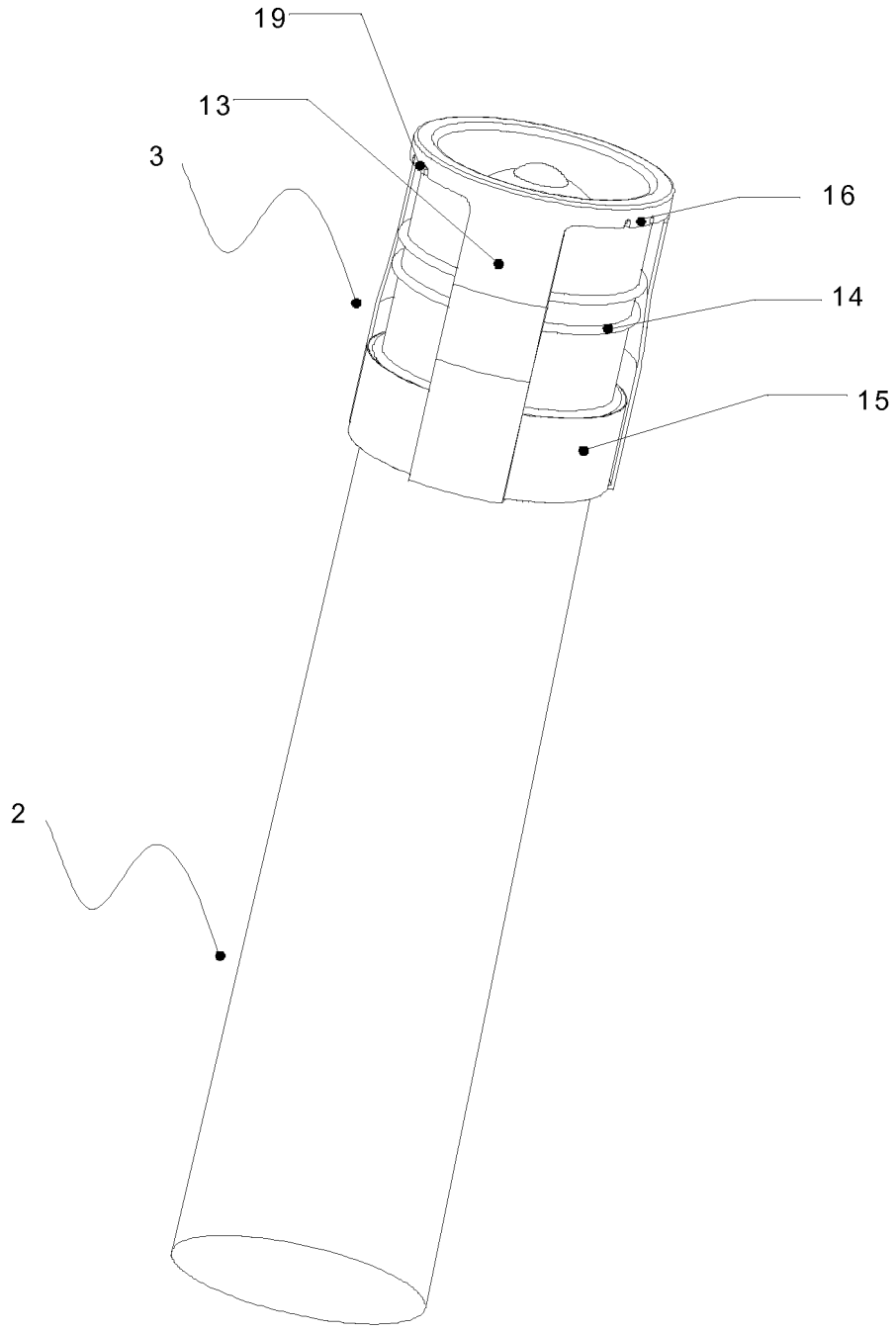
FIG. 5 is a structural diagram of a cartridge of the invention.
Figure 6:
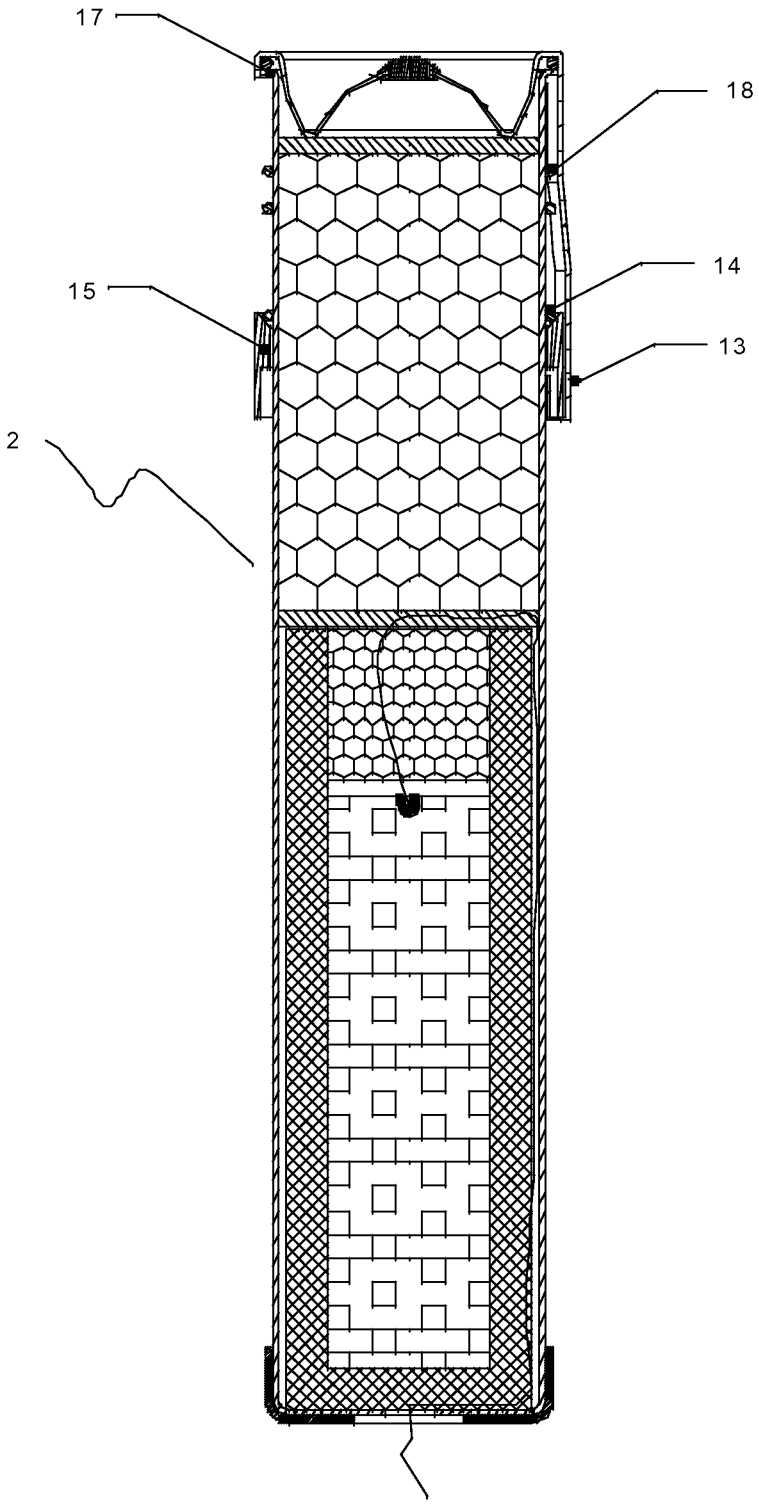
FIG. 6 is a sectional view of a cartridge of the invention.

Referring to FIG. 5 and FIG. 6, the cartridge 2 of the invention is improved based on an existing cartridge 2, and a pyrotechnic column, an ignition head on the front end face of the pyrotechnic column, a coolant, and a ceramic cellular cooling layer are provided in the cartridge in turn. In addition, a heat insulation layer is coated between the inner call of the cartridge 2 and the pyrotechnic column. Or the cartridge 2 may be also a cartridge 2 of another structure applicable to the portable fire extinguishing device. Another remarkable characteristic of the invention is that the jet end of the cartridge 2 is further provided with an explosion venting device 3 and the bottom end of the outer wall of the cartridge 2 is provided with a locating lug boss; the locating lug boss further needs to fit the structures of the first half casing 4 and the second half casing 5, i.e. clamping grooves are provided on corresponding positions of the first half casing 4 and the second half casing 5 so that the locating lug boss can be right clamped in the clamping grooves; in this way, the cartridge 2 can be located accurately after the first half casing 4 and the second half casing 5 are folded, thus limiting the degree of freedom of the cartridge in the casing 1. A specific structure of the explosion venting device 3 may be described as follows: it mainly comprises a frictional layer 14, a link 13, a link guiding unit 15 and a link limiting device 16; the link 13 and the cartridge cover of the cartridge 2 are fixedly connected through welding and riveting etc., or may be directly integrated. The frictional layer 14 is provided between the link 13 and the outer wall of the cartridge 2, and may be directly fixed on the inner wall of the link 13. The frictional layer 14 provides a friction resistance and a buffering force for the link 13 when the same is guided by the link guiding unit 15 to displace along a direction towards which a hot air stream of the cartridge 2 is ejected. The frictional layer may be one or more rubber rings, or silicone layers or other materials capable of providing a sufficient frictional resistance for axial sliding of the link 13. The link guiding unit 15 is a device capable of providing a guiding function for the link 13 when the same is moving, and may be a guiding ring fixedly connected with the link 13, or may be also a guiding groove provided on the outer wall of the cartridge 2 and capable of enabling the link 13 to slide along the guiding groove, or other structures having a guiding function; this guiding structure can prevent the link 13 from being offset or clamped during a moving process on the cartridge 2. When the guiding ring is applied to guiding, the guiding ring may be fixedly connected or directly integrated with an extremity of the link 13. The link limiting device 16 is a device capable of fixing the link 13 and limiting the link 13 when the extremity of the same slides to the jet end of the cartridge 2, and mainly comprises a clamping claw 19 for fixing the link 13 and a flanging 17 for limiting the displacement of the link 13. One end of the clamping claw 19 is fixed on the link 13 and the other end is clamped with the jet end of the cartridge 2 to mainly fix the link 13 and prevent the same from being loosened in a normal condition. The flanging 17 needs to be fixedly connected with the jet end of the cartridge 2, and they may be welded or integrated directly, mainly aiming at preventing the link 13 or the whole explosion venting device 3 from being separated from the cartridge 2 and being out of control when the extremity of the link 13 moves to the ejecting end of the cartridge 2. An elastic body 18 is further provided between the flanging 17 and the guiding ring or on the inner side face of the flanging 17 to have a buffering function when the extremity of the link 13 collides with the flanging 17.

The displacement of the link 13 of the invention is preferably controlled within 50 to 60 mm, because excessive displacement will fail to reduce a recoil force; however, the kinetic energy cannot be consumed thoroughly by little displacement, and the cover body of the cartridge 2 is very likely to get rid of the blockage of the link limiting device 12. Once the cover body of the cartridge 2 is separated from the cartridge 2, a powerful recoil force will be generated. However, the displacement of the link 13 may be adjusted appropriately according to a specific application environment, as long as an optimal explosion venting effect can be realized.

When the pyrotechnic column is ignited and released normally, hot air is released from the cover body, and an oversize air stream will not be generated. Thus the explosion venting device 3 will not be started, and the link 13, which is fixed on the cartridge 2 by the clamping claw 19, will not move along an axial direction of the cartridge 2 to generate displacement. Only when the cover body of the cartridge 2 and the link 13 are pushed by a powerful hot air stream generated by unexpected explosive deflagration to move in a direction towards which the hot air stream is ejected, the clamping claw 19 of the link limiting device 16 slips under the action of a powerful impact force on one hand to consume a part of the impact kinetic energy. Pushed by the hot air stream, the link 13 drives the guiding ring to slide axially along the outer wall of the cartridge 2 to generate displacement, and the frictional layer 14 generates frictional resistance to the link during the moving process to consume a part of the impact kinetic energy. When the extremity of the link 13 reaches the spout of the cartridge 2, the flanging 17 of the link limiting device 16 fixed on the cartridge 2 stops the extremity of the link 13 from being separated from the cartridge 2. At the moment, the elastic body 18 provided between the flanging 17 and the guiding ring functions to consume a part of the impact kinetic energy with its elasticity, and buffers the powerful impact force between the extremity of the link 13 and the flanging 17 additionally. When the final kinetic energy acts on the flanging 17 in the form of collision, the flanging 17 is deformed elastically or plastically, which will consume all remaining kinetic energy. Thus the powerful impact kinetic energy generated by deflagration of the pyrotechnic column may be well consumed or dispersed in the whole process to avoid injuries or damages brought thereby.

The fire extinguishing device of the invention is started by ignition with piezoelectric ceramics. The lower end of the piezoelectric ceramics is clamped in a corresponding installation groove at the bottom of the first half casing 4 or the second half casing 5 and the other end corresponds to starting push button provided on the wall of the second half casing 5 or the first half casing 4. At the same time, a locating groove matched with the bottom cover 7 is provided on the bottom cover to fix the bottom cover. A safety pin capable of locking the piezoelectric ceramics and preventing the same from being started by mistake is provided on the bottom cover 7 of the casing 1. The safety pin is connected with a pull ring exposed out of the bottom cover 7.

In use, the pull ring is pulled out first and the safety pin is unlocked; the push button is pressed and the device can be started through the piezoelectric ceramics, thus igniting the pyrotechnic column.

The portable fire extinguishing device of the invention is not limited to the structure above.

The invention claimed is:

1. A portable fire extinguishing device, comprising a casing (1) and a cartridge (2) provided inside the casing (1), wherein the casing (1) comprises a first half casing (4), a second half casing (5) fitted to the first half casing (4), a fastening ring (6) and a bottom cover (7); the first half casing (4) and the second half casing (5) are butted; the fastening ring (6) is provided on the top ends of the first half casing (4) and the second half casing (5) so as to fasten the first half casing (4) and the second half casing (5); and the bottom cover (7) is provided at the bottoms of the first half casing (4) and the second half casing (5);

the inner walls of the first half casing (4) and the second half casing (5) are respectively provided with annular ribs (11) and clamping ribs (12) corresponding with each other; the annular ribs extend in a circumferential direction of the casing and are capable of implementing radial locating; the clamping ribs are capable of implementing axial locating; the annular ribs (11) are fitted with the outer wall of the cartridge (2);

wherein a jet end of the cartridge (2) is further provided with an explosion venting device (3);

wherein the explosion venting device (3) comprises a frictional layer (14), a link (13), a link guiding unit (15) and a link limiting device (16); the link (13) is connected with a cartridge cover of the cartridge (2); the frictional layer (14) is provided between the link (13) and the outer wall of the cartridge (2); the frictional layer (14) provides a frictional resistance and a buffering force for the link (13) when the link (13) is guided by the link guiding unit (15) to displace along a direction towards which a hot air stream of the cartridge (2) is effected; link guiding unit (15) is a device capable of providing a guiding function for the link (13) when the link (13) is moving; the link limiting device (16) is a device capable of fixing the link (13) when an extremity of the link (13) reaches an spout of the cartridge (2).

2. The portable fire extinguishing device according to claim 1, wherein the first half casing (4) and the second half casing (5) are fixedly connected by means of clamping, riveting, or threaded connection.

3. The portable fire extinguishing device according to claim 2, wherein the first half casing (4) and the second half casing (5) are locked through a clamping hook (8) provided at the edge of the first half casing (4) and a clamping hole (9) provided at the edge of the second half casing (5) and corresponding to the clamping hook (8), or the first half casing (4) and the second half casing (5) are locked through a clamping hook (8) provided at the edge of the first half casing (4) and a clamping hole (9) provided at the edge of the first half casing (4) and corresponding to the clamping hook (8).

4. The portable fire extinguishing device according to claim 1, wherein annular bumps (10) are provided at the outer walls of two ends of the first half casing (4) and the second half casing (5); the inner walls of the fastening ring (6) and the bottom cover (7) are provided with clamping points corresponding to the annular bumps (10).

5. The portable fire extinguishing device according to claim 1, wherein the link guiding unit is a guiding ring fixedly connected with the link (13) or a guiding groove provided on the outer wall of the cartridge (2) and capable of enabling the link (13) to slide axially along the guiding groove; the link limiting device (16) comprises a flanging (17) fixedly connected with the spout end of the cartridge (2) and a clamping claw (19) for fixing the link (13); an elastic body (18) is provided between the flanging (17) and the link guiding unit (15) or is provided on a side face of the flanging (17).

6. The portable fire extinguishing device according to claim 1, wherein the bottom of the cartridge (2) is provided with a locating lug boss fitted to the inner wall of the casing (1).

7. The portable fire extinguishing device according to claim 2, wherein annular bumps (10) are provided at the outer walls of two ends of the first half casing (4) and the second half casing (5); the inner walls of the fastening ring (6) and the bottom cover (7) are provided with clamping points corresponding to the annular bumps (10).

8. The portable fire extinguishing device according to claim 3, wherein annular bumps (10) are provided at the outer walls of two ends of the first half casing (4) and the second half casing (5); the inner walls of the fastening ring (6) and the bottom cover (7) are provided with clamping points corresponding to the annular bumps (10).

* * * * *